US006745850B2

(12) United States Patent
Hahn

(10) Patent No.: US 6,745,850 B2
(45) Date of Patent: Jun. 8, 2004

(54) TOOL HOLDER FOR HAMMER

(75) Inventor: Norbert Hahn, Limbach (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/241,111

(22) Filed: Sep. 11, 2002

(65) Prior Publication Data

US 2003/0047888 A1 Mar. 13, 2003

(30) Foreign Application Priority Data

Sep. 12, 2001 (GB) ..... 0121947

(51) Int. Cl.[7] ..... B25D 17/00

(52) U.S. Cl. ..... 173/132; 173/130; 173/133; 173/216; 173/217

(58) Field of Search ..... 173/48, 130, 132, 173/133, 210, 216, 217; 279/75, 82, 81, 87; 408/58, 226; 409/234

(56) References Cited

U.S. PATENT DOCUMENTS

| | | | | |
|---|---|---|---|---|
| 2,990,188 A | * | 6/1961 | Better et al. | 279/75 |
| 4,107,949 A | * | 8/1978 | Wanner et al. | 464/167 |
| 4,377,292 A | * | 3/1983 | Staron | 279/46.1 |
| 4,691,929 A | * | 9/1987 | Neumaier et al. | 279/19.3 |
| 5,016,892 A | * | 5/1991 | Lafforgue et al. | 279/82 |
| 5,505,570 A | | 4/1996 | Meyen | |
| 5,558,478 A | * | 9/1996 | Odendahl et al. | 408/226 |
| 6,092,814 A | * | 7/2000 | Kageler | 279/19.4 |
| 6,179,300 B1 | * | 1/2001 | Baumann et al. | 279/19.4 |

FOREIGN PATENT DOCUMENTS

| | | |
|---|---|---|
| DE | 2117628 | 10/1972 |
| DE | 7429418 | 3/1976 |
| DE | 3516541 | 11/1986 |
| DE | 3536132 | 4/1987 |
| DE | 3714679 | 11/1988 |
| DE | 4103663 | 8/1992 |
| DE | 9305463 | 5/1993 |
| DE | 4343638 | 6/1995 |
| DE | 29612795 | 1/1998 |
| DE | 29703683 | 8/1998 |
| DE | 19914577 | 10/2000 |

* cited by examiner

*Primary Examiner*—Scott A. Smith
*Assistant Examiner*—Chukwurah Nathaniel
(74) *Attorney, Agent, or Firm*—Michael P. Leary; Bruce S. Shapiro; Charles E. Yocum

(57) ABSTRACT

A tool holder for a hammer comprises a tool holder body having a forward end for non-rotatably receiving a shank of a tool. The tool holder body defines an axially extending slot. A locking body extends through the slot for releasably engaging an axially extending closed groove formed in the tool shank. A locking ring surrounds the tool holder body and in a locked position holds the locking body in a radially inward position in which the locking body engages the groove in the tool and in a release position allows the locking body to move into a radially outward position so that a tool can be inserted into or removed from the tool holder body. The locking ring is shiftable in a direction transverse to the fore-aft axis of the tool holder body to allow the locking body to move into a radially outward position.

45 Claims, 5 Drawing Sheets

TOOL HOLDER FOR HAMMER

BACKGROUND OF THE INVENTION

This invention relates to a tool holder for a hand held electrically powered hammer and to a hand held electrically powered hammer incorporating such a tool holder. In particular this invention relates to tool holders for demolition hammers.

Such hammers generally comprise a housing within which is located an electric motor and a gear arrangement for converting the rotary drive of the motor to a reciprocating drive to drive a piston within a hollow spindle or cylinder, which spindle is located within the hammer housing. A ram is located in front of the piston within the spindle so as, in normal operating conditions, to form a closed air cushion within the spindle between the piston and the ram. The reciprocation of the piston reciprocatingly drives the ram via the air cushion. A hollow piston arrangement may be used, as is well known in the art. A beatpiece is generally located within the spindle and transmits repeated impacts that it receives from the ram to a tool or bit releaseably mounted for limited reciprocation in front of the beatpiece in a tool holder portion. The impacts on the tool or bit are transmitted to a workpiece against which the tool or bit is pressed in order to break up or make a bore in the workpiece.

Some hammers may also be employed in combination impact and drilling mode in which the tool holder, and hence the tool inserted therein, will be caused to rotate at the same time as the tool is struck by the beatpiece. The present invention is also applicable to such hammers.

A common form of chiselling tool or bit, for performing heavy duty work is a hex-shanked tool or bit. The portion of the tool which is locked within the tool holder of the hammer has a hexagonal transverse cross-section. The bore in the tool holder which receives the hexagonal shank portion generally has a corresponding hexagonal transverse cross-section and so the tool is non-rotatably fitted within the tool holder. The hexagonal portion is formed on one of its flats with an axially extending groove which is closed at both its ends. The hex-shanked tool can be locked within the tool holder to enable limited reciprocation of the tool within the tool holder. Traditionally, a cross bolt arrangement is used to lock the tool within the tool holder. The bolt extends tangentially of the toolholder to engage the groove in the tool. The bolt can be retracted or pivoted outwardly to allow insertion or removal of the tool.

An alternative to a hex-shanked tool or bit for use on hammers is an SDS-type tool or bit. The SDS-type tools have a tool shank which is provided with irregularly positioned axially extending grooves, open at their rearward ends which grooves co-operate with radially inwardly extending splines in the bore of the tool holder. Thus, the tool is non-rotatably fitted within the tool holder. In addition the SDS-type tools have two axially extending grooves which are closed at their ends and which are each engageable by a locking body in order to lock the tool within the tool holder so as to allow limited reciprocation of the tool within the tool holder. Tool holders for SDS-type tools generally have one or two radially shiftable locking bodies which can be releaseably locked within one of the, or each, groove of a tool inserted into the tool holder.

It is an aim with tool holders for hammers to have a simple, compact and ergonomic design in which the locking body can move between its radially inward locked position and its radially outward unlocked position smoothly. It is also advantageous to provide automatic locking of a tool within the tool holder, to enable the tool to be locked in the tool holder automatically by simply pushing the tool into the tool holder, without manually actuating the tool holder.

SUMMARY OF THE INVENTION

The present invention aims to overcome at least some of the problems discussed above by providing a simple, compact and ergonomic design of tool holder.

According to a first aspect of the present invention there is provided a tool holder for an electrically powered hammer comprising:

a tube-like tool holder body which can be fitted to or formed at the front of a hammer and having a forward end for non-rotatably receiving a shank of a tool or bit wherein said forward end is formed with a single axially extending slot;

a single locking body extending through said slot for releasably engaging an axially extending closed groove formed in a tool fitted in said forward end of the tool holder body; and a locking member which extends around the tool holder body and in a locked position locks the locking body in a radially inward position in which the locking body is engageable with the groove in the tool and in a release position allows the locking body to move into a radially outward position to allow a tool to be inserted into or removed from the forward end of the tool holder body;

wherein the locking member is shiftable in a direction transverse to the fore-aft axis of the tool holder body to allow the locking body to move into a radially outward position.

By making the locking member shiftable in a direction transverse to the fore-aft axis of the tool holder the member can simply be shifted transversely between a locked position in which it engages the locking body to hold the locking body within the groove of a tool or bit inserted into the tool holder body and an unlocked position in which the locking body is free to move radially outwardly to enable insertion and/or removal of the tool or bit.

The locking member may extend all the way around the tool holder body and may, for example, be a locking ring.

To shift the locking member, it is preferred that there is provided a manually actuable tool release member for moving the locking member which tool release member can be actuated to move the tool release member between a locked position which corresponds to the locked position of the locking member and a release position which corresponds to the release position of the locking member. Preferably, the manually actuable tool release member can be actuated to move the locking member between the locked position and an intermediate position, in which intermediate position the locking member is shiftable in a direction transverse to the fore-aft axis of the tool holder body to its release position to allow the locking body to move into a radially outward position. Thus, with the locking member in its intermediate position, the locking body can shift the locking member to its release position when the locking body in urged radially outwardly by the shank of a tool or bit. For a particularly, ergonomic and simple design, the manually actuable tool release member may be axially shiftable on the tool holder body.

In one embodiment of the present invention, in the locked position the locking member can engage a protrusion on the tool holder body in order to lock the locking member in its locked position. Then the tool release member is preferably moveable to axially shift the locking member between the locked position of the locking member in which it engages the protrusion on the tool release sleeve and the intermediate position of the locking member in which the locking member does not engage the protrusion and so is free to shift transversely into its release position.

The tool release member may be a tool release sleeve which is co-axial with the tool holder body and within which is mounted the locking member so as to enable locking member, when in the intermediate position to shift with respect to the tool release sleeve in a direction transverse to the fore-aft axis of the tool holder body. For a robust and simple design the locking member may be mounted within the tool release sleeve, between a first set of radially inwardly directed teeth of the sleeve and a second set of radially inwardly directed teeth of the sleeve.

To enable automatic movement of the locking member into its locked position, the locking member may be biased by at least one spring member into the locked position. Alternatively, or in addition a biasing member, preferably a biasing ring may extend around, preferably all the way around the tool holder body and be used to bias the locking member into the locked position.

In a preferred embodiment of the present invention which enables insertion of a tool or bit within the tool holder body without manual actuation of the tool release member, the slot in the tool holder body extends rearwardly of the locking body, the biasing ring biases the locking body forwardly within the slot into its locked position and the locking body and the locking member are axially moveable together such that insertion of a tool within the tool holder body pushes the locking body axially rearwardly within the slot and thereby pushes the locking member and biasing ring axially rearwardly against the biasing force of the biasing ring and into an intermediate position, in which intermediate position the locking member is shiftable in a direction transverse to the fore-aft axis of the tool holder body to allow the locking body to move into a radially outward position. Then the tool can be inserted further into the tool holder body and the biasing ring biases the locking member and thereby the locking body into its locked position in which the locking body engages the groove in the tool or bit to lock the tool or bit within the tool holder body.

It can be arranged for the biasing ring to engage the tool release member so that axial movement of the biasing ring causes axial movement of the tool release member. This is of particular advantage when the tool is a hex-shanked tool which can be inserted into the tool holder body in an incorrect orientation in which the groove in the tool does not face the locking body. When a tool is incorrectly inserted in the wrong orientation, then the biasing ring cannot move forwardly to urge the locking member and thereby the locking body into its locked position because the shank of the tool traps the locking body in its radially outward position. This problem is made immediately apparent to the user of the hammer due to the failure of the tool release member to move into its locked position, because the tool release member cannot move into its locked position due to its engagement with the biasing ring. The biasing ring may engage a set of teeth of the tool release sleeve described above, which teeth limit the movement of the biasing ring within the sleeve.

In a particularly simple and compact design, the locking member is shiftable in a locking assembly comprising a forward support member located forwardly of the locking member and a rearward support member located rearwardly of the locking member. This locking assembly is preferably axially fixed with respect to the tool release member, particularly where the tool release member is an axially shiftable tool release sleeve. The rearward support member may have the dual function of also being the biasing ring.

In order to damp the transfer of the impact on the locking body to the tool holder body, on entry of a hammer incorporating the tool holder-into idle mode, the forward movement of the locking body within the slot may be limited by a damping arrangement which arrangement is axially fixed against forward movement on the forward portion of the tool holder body. Preferably, the damping arrangement comprises a metal ring, a resilient ring, which is deformable to damp the impact, located forwardly of the metal ring and a fixing ring located forwardly of the resilient ring.

The tool holder according to the present invention is particularly suited to a hex-shanked tool having a shank with a transverse hexagonal cross-section. However, it can also be used in relation to SDS-type tools and other tool types which are used in relation to hammers.

According to a second aspect of the present invention there is provided an electrically powered hammer preferably having a pneumatic striking mechanism comprising a piston and ram located so as to reciprocate within a hollow spindle and additionally including a tool holder as described above.

BRIEF DESCRIPTION OF THE DRAWINGS

One form of hammer incorporating a tool holder according to the present invention will now be described by way of example with reference to the accompanying drawings in which.

DETAILED DESCRIPTION OF THE INVENTION

Figure 3:
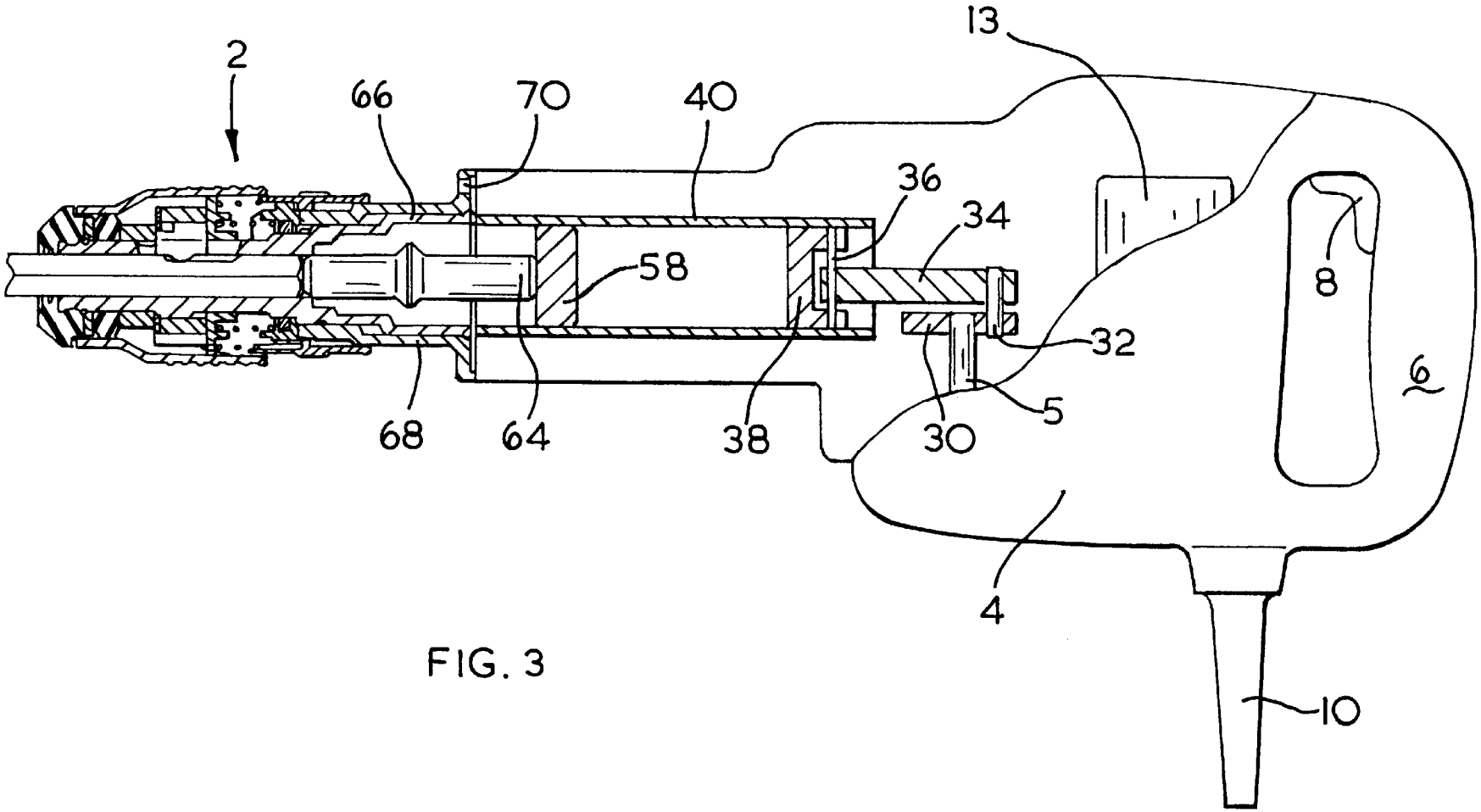
FIG. 3 shows a partially cut-away longitudinal cross-section of a demolition hammer having a tool holder as shown in FIGS. 1 and 2.

A demolition hammer incorporating a tool holder (2) according to the present invention is shown in FIG. 3. The hammer comprises an electric motor (13), a gear arrangement and a piston drive arrangement which are housed within a metal gear housing (not shown) surrounded by a plastic housing (4). A rear handle housing incorporating a rear handle (6) and a trigger switch arrangement (8) is fitted to the rear of the housing (4). A cable (not shown) extends through a cable guide (10) and connects the motor to an external electricity supply. Thus, when the cable is connected to the electricity supply and the trigger switch arrangement (8) is depressed the motor (13) is actuated to rotationally drive the armature of the motor.

The motor pinion rotatingly drives a first gear wheel of an intermediate gear arrangement which is rotatably mounted on a spindle, which spindle is mounted in an insert to the gear housing. The intermediate gear has a second gear wheel which rotatingly drives a drive gear. The drive gear is non-rotatably mounted on a drive spindle (5) which spindle is rotatably mounted within the gear housing. A crank plate (30) is non-rotatably mounted at the end of the drive spindle (5) remote from the drive gear, which crank-plate is formed with an eccentric bore for housing an eccentric crank pin (32). The crank pin (32) extends from the crank plate into a bore at the rearward end of a crank arm (34) so that the crank arm (34) can pivot about the crank pin (32). The opposite forward end of the crank arm (34) is formed with a bore through which extends a trunnion pin (36) so that the crank arm (34) can pivot about the trunnion pin (36). The trunnion pin (36) is fitted to the rear of a piston (38) by fitting the ends of the trunnion pin (36) into receiving bores formed in a pair of opposing arms which extend to the rear of the piston (38). The piston is mounted in a cylindrical hollow spindle (40) so that it can reciprocate within the hollow spindle. An O-ring seal is fitted in an annular recess formed in the periphery of the piston (38) so as to form an air tight seal between the piston (38) and the internal surface of the hollow spindle (40).

Thus, when the motor (13) is actuated, the armature pinion rotatingly drives the intermediate gear arrangement via the first gear wheel and the second gear wheel of the intermediate gear arrangement rotatingly drives the drive spindle via the drive gear. The drive spindle rotatingly drives the crank plate (30) and the crank arm arrangement comprising the crank pin (32), the crank arm (34) and the trunnion pin (36) convert the rotational drive from the crank plate (30) to a reciprocating drive to the piston (38). In this way the piston (38) is reciprocatingly driven back and forth along the hollow spindle (40) when the motor is actuated by a user depressing the trigger switch (8).

A ram (58) is located within the hollow spindle (40) forwardly of the piston (38) so that it can also reciprocate within the hollow spindle (40). An O-ring seal is located in a recess formed around the periphery of the ram (58) so as to form an air tight seal between the ram (58) and the spindle (40). In the operating position of the ram (58) a closed air cushion is formed between the forward face of the piston (38) and the rearward face of the ram (58). Thus, reciprocation of the piston (38) reciprocatingly drives the ram (58) via the closed air cushion.

After a period of hammering, when the tool (3) fitted in the tool holder is removed from the workpiece, the hammer enters idle mode. With no workpiece to urge the tool rearwardly, the next forward impact from the ram (58) meets with no rearward resistance and the ram (58), beatpiece (64) and tool (3) move forwardly until the forward movement of the tool is halted by the engagement of the locking body (54) with the rearward end of the groove (88) in the tool. As the ram (58) moves forwardly in the hollow spindle (40) it passes over venting holes on the hollow spindle and the air cushion between the piston (38) and the ram (58) is vented. Thereafter, the ram (58) is no longer reciprocatingly driven by the piston (38). Some mechanism is generally employed for holding the ram (58) and beatpiece (64) in their forward positions until the tool (3) is again urged against a workpiece to urge the ram (58) and beatpiece (64) into their rearward working positions again in which the air cushion is closed. As indicated above on entry into idle mode the last forward impact from ram (58) to the beatpiece (64) is transmitted to the tool (3) which tool transfers the forward impact to the locking body (54) when the rearward end of the groove (88) impacts the rearward end of the locking body (54).

A beatpiece (64) is guided so that it can reciprocate within a tool holder body (66) which tool holder body is mounted at the forward end of the hammer housing co-axially with the spindle. The tool holder body is mounted within a flange (68) which is fitted to the main housing of the hammer by a plurality of bolts (not shown) which extend axially through receiving bores (70) in a collar located at the rearward end of the flange (68). The bolts extend into co-operating receiving screw threaded bores formed in the forward part of the main housing of the hammer. A hex-shanked bit or tool (3) can be releasably mounted within the tool holder body (66) so that the tool can reciprocate to a limited extent within the tool holder body (66). When the ram (58) is in its operating mode and is reciprocatingly driven by the piston (38) the ram repeatedly impacts the rearward end of the beatpiece (64) and the beatpiece (64) transmits these impacts to the rearward end of the tool (3) as is known in the art. These impacts are then transmitted by the tool (3) to the material being worked.

Figure 1:
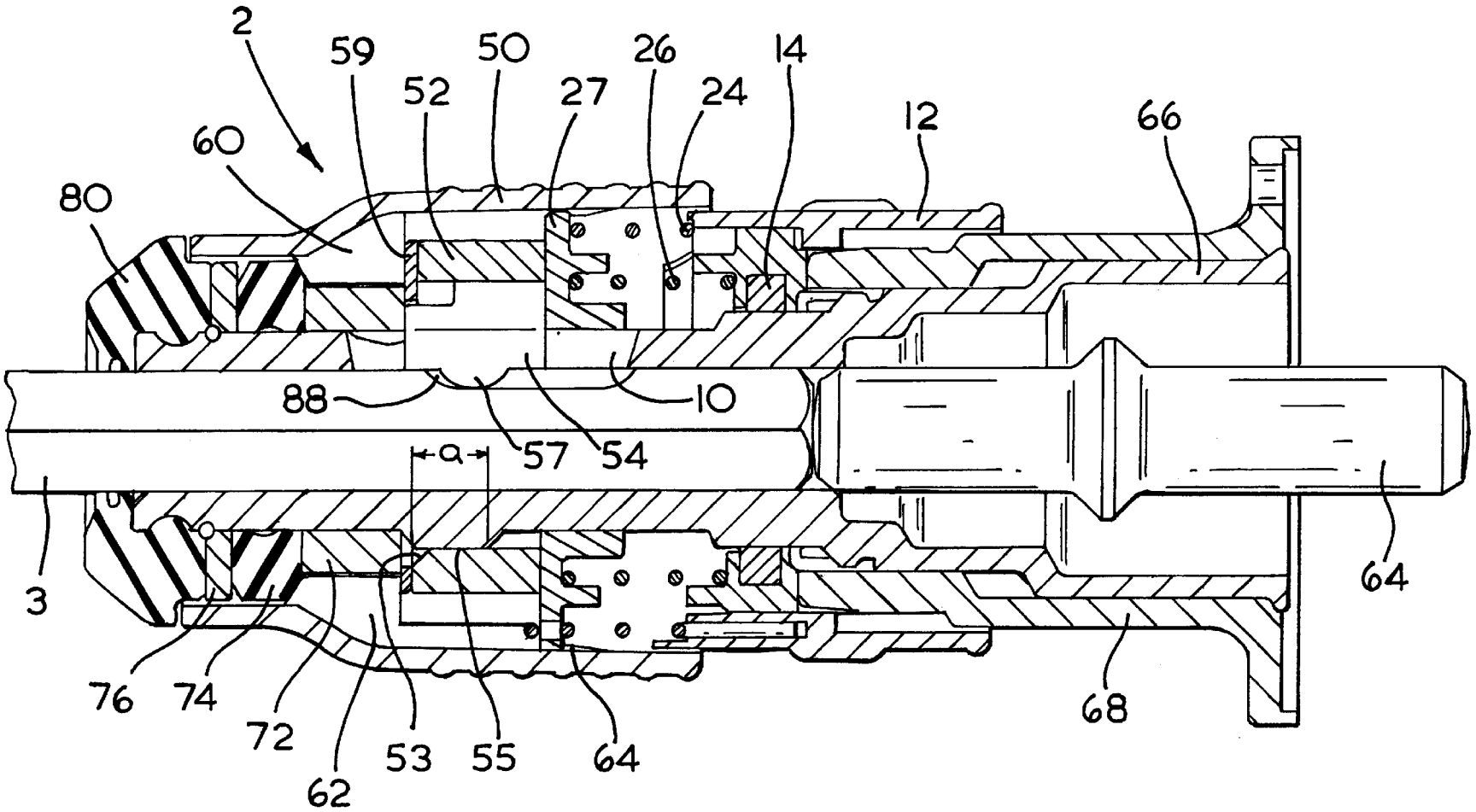
FIG. 1 shows a longitudinal cross section through a tool holder of a hammer according to the present invention with a tool locked within it.
Figure 2:
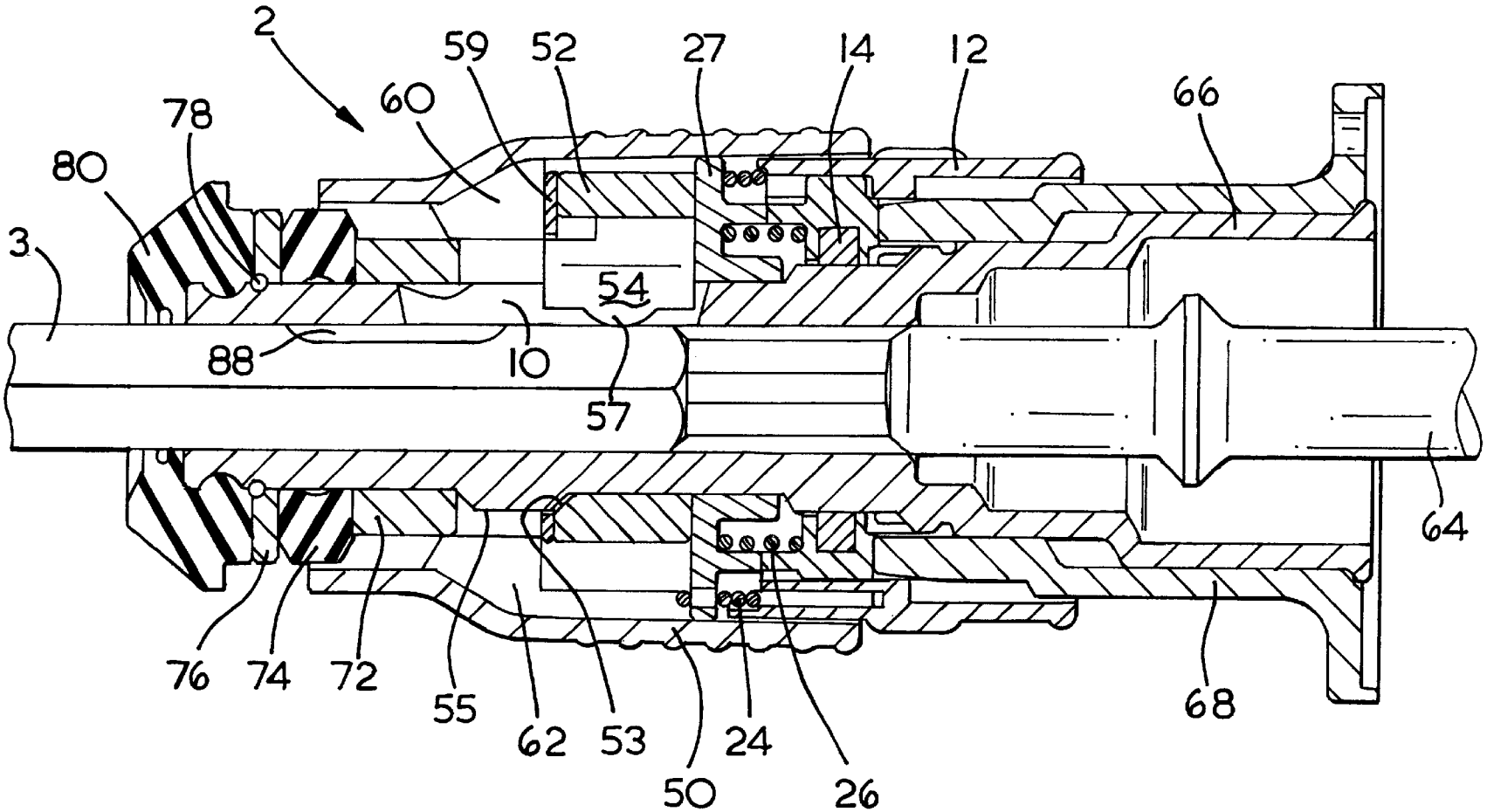
FIG. 2 shows a longitudinal cross section through the tool holder of FIG. 1 during the insertion or release of a hex-shanked tool.

The tool holder (2) of the hammer of FIG. 3 is shown in more detail in FIGS. 1 and 2. The tool holder (2) comprises a tube-like tool holder body (66). The tool holder body had a relatively large internal diameter cylindrical portion at its rearward end for housing the beatpiece (64) and a relatively small diameter hexagonally cross-sectioned portion at its forward end for receiving the shank of a hex-shanked tool (3).

Figure 4:
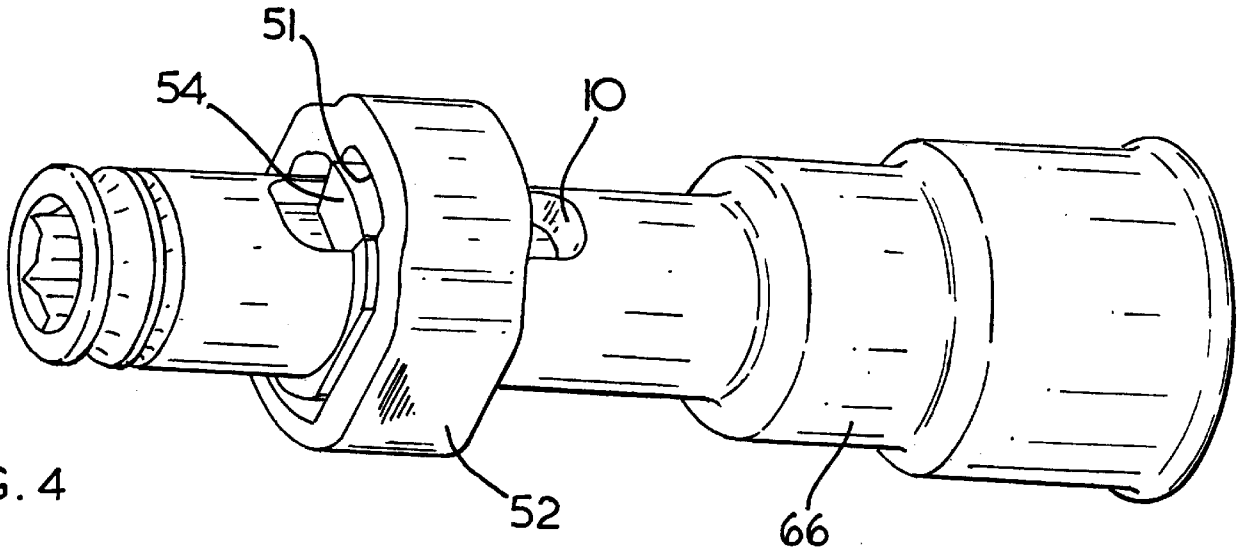
FIG. 4 shows a perspective view of the tool holder body of the tool holder of FIGS. 1 and 2, with the locking ring and locking body fitted on it.
Figure 5:
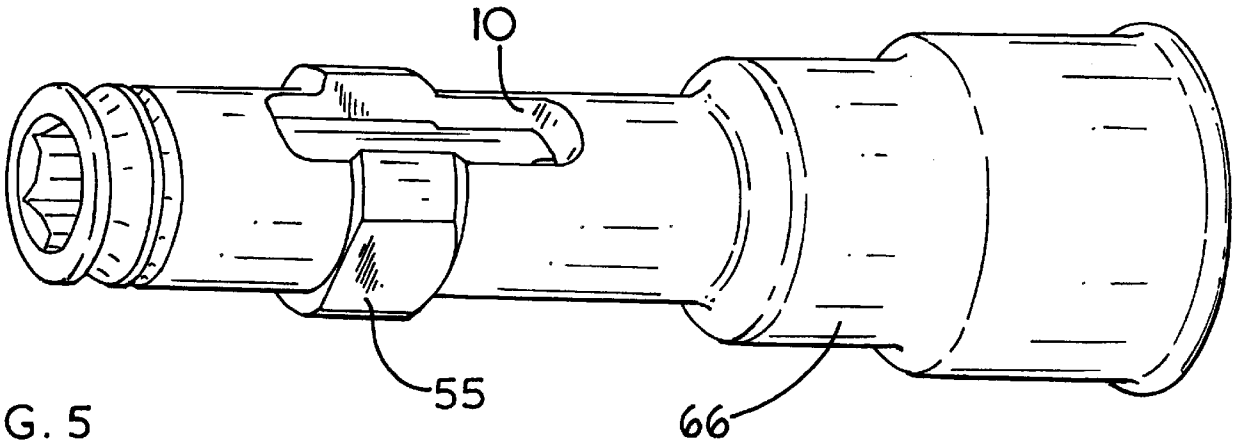
FIG. 5 shows a perspective view of the tool holder body of the tool holder of FIGS. 1 and 2.
Figure 7:
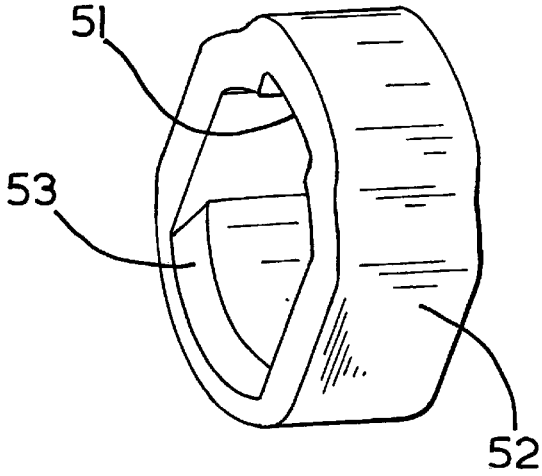
FIG. 7 shown a perspective view of the locking ring the tool holder of FIGS. 1 and 2.

The forward end of the tool holder body (66) is formed with an axially extending slot (10) through which a locking body (54) extends. A radially outwardly extending projection (55), as shown in FIGS. 1, 2 and 5 is formed around the tool holder body (66) in a position towards the forward end of the slot (10) in the tool holder body. A locking ring (52) which is shown in perspective view in FIGS. 4 and 7 is non-rotatably mounted over the tool holder body (66) so that a pocket (51) in the radially inwardly facing surface of the locking ring lies radially outwardly of the locking body (54). The locking ring (52) has a portion which is diametrically opposed to the pocket (51) which portion is formed with a chamfer (53) on its forwardly facing end surface. The chamfered portion of the locking ring lies radially outwardly of the projection (55) in the locked position of the tool holder. The projection (55) has a sloping rearward facing surface, the angle of which slope matches the angle of the chamfer (53).

Figure 6:
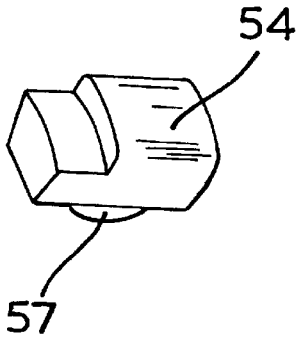
FIG. 6 shows a perspective view of the locking body of the tool holder of FIGS. 1 and 2.

The locking body (54), which is shown in perspective in FIG. 6, has a radially inwardly extending projection (57) which has a curved surface in the fore-aft direction, which curved surface matches the shape of the curved forward and rearward closed ends of the axial groove (88) in the hex-shanked tool (3). The width of the locking body (54) in the circumferential direction of the tool holder body matches the width of the slot (10). The radially outwardly facing surface of the locking body (54) is stepped in the axial direction with the rearward part of said surface located radially outwardly of the forward part of said surface. A metal washer (59) extends around the tool holder body (66) and abuts the front end surface of the locking ring (52). The radially inward part of the washer (59) is shaped to fit over the forward part of the radially outwardly facing surface of the locking body (54). It is also shaped to fit over the projection (55) on the tool holder body (66) when the locking ring (52), locking body (54) and washer (59) are moved rearwardly on the tool holder body (66), as shown in FIG. 2. The forward movement of the washer (59) (and thereby the locking ring (52) and the locking body (54)) is limited by a metal ring (72) non-rotatably mounted over the tool holder body (66), which metal ring forms part of an impact damping arrangement (72, 74, 76). The rearward facing face of the metal ring (72) abuts a part of the forward facing face of the locking body (54) and of the washer (59) in the normal operating position of the tool holder, which is shown in FIG. 1. The impact damping arrangement includes a deformable ring (74) located forwardly of the metal ring (72) and a washer (76) located forwardly of the deformable ring (74). The washer (76) and thereby the damping arrangement is prevented from forward movement on the tool holder body (66) by a circlip (78) which fits within a recess in the tool holder body. A rubber nose ring (80) fits over the front of the tool holder body (66) forwardly of the damping arrangement.

A biasing ring (27) is non-rotatably mounted on the tool holder body (66) rearwardly of the locking body (54) and locking ring (52) and biases the locking body (54) and locking ring (52) forwardly. The biasing ring (27) is biased forwardly by two springs (24, 26). The rearward end of the springs (24, 26) bear against parts of an arrangement for altering the rotational orientation of the tool holder body (66) within the flange (68) and comprises a rotatable actuator sleeve (12) and a locking ring (14) and is not further described here.

The impact damping arrangement (72, 74, 76), washer (59), locking ring (52), locking body (54), biasing sleeve (27) and spring (24, 26) assembly discussed above is surrounded by a tool release sleeve (50). The sleeve (50) has a first set of radially inwardly directed teeth (60, 62) which have rearwardly facing end faces which abut part of the forward facing face of the washer (59). The teeth (62) have rearward extensions which also abut the forward face of the biasing ring (27). The sleeve (50) also has a second set of inwardly directed teeth (64) which abut a rearward facing surface of the biasing ring (27). Thus, the washer (59), ring (52) and biasing ring (27) and thereby the locking body (54) are axially restrained within the tool release sleeve (50) between the sets of teeth (60, 62) and (64), with the locking ring and washer shiftable in a direction transversely to the fore-aft axis of the tool holder body between the forward face of the biasing ring (27) and the set of teeth (60, 62). On assembly of the tool holder the biasing sleeve (27) is pushed over the rearwardly facing sloping surfaces of the teeth (64) to snap fit in front of the teeth (64) to abut the previously assembled locking ring (52) and locking body (54). Thus, the tool release sleeve (50) is forwardly biased indirectly by the springs (24, 26) via the biasing ring (27), locking ring (52) and washer (59). Thus, a locking assembly comprising the tool release sleeve (50), locking body (54), locking ring (52) and biasing sleeve (27) all move axially as a single block, within which block the locking ring (52) and the locking body (54) can shift in a direction transverse of the fore-aft axis of the tool holder body, once the locking ring (52) is moved rearwardly of the projection (55) on the tool holder body.

The teeth (60, 62) surround the metal ring (72) of the damping arrangement and forward faces of the teeth (60, 62) abut part of the rearward face of the deformable ring (74) of the damping arrangement which limits the axially forward movement of the tool release sleeve (50). The tool release sleeve can be manually shifted axially rearwardly to the position shown in FIG. 2 against the force of the biasing springs (24, 26). The axial shifting of the tool release sleeve (50) axially shifts the washer (59), locking ring (52), locking body (54) and biasing sleeve (27) rearwardly by virtue of their engagement with the teeth (60, 62, 64). When the tool release sleeve (50) is subsequently released from the position in FIG. 2, the springs (24, 26) move the tool release sleeve (50) forwardly back into the FIG. 1 position, thereby shifting the locking assembly comprising washer (59), locking ring (52), locking body (54) and biasing sleeve (27) forwardly.

Referring to FIG. 1, it should be noted that the slot (10) in the tool holder body (66) extends for a distance greater then the axial length (a) of the part of the projection (55) which the locking ring (52) overlaps in the locked position of FIG. 1. Thus, on insertion of a tool (3) within the tool holder body the rearward end of the tool shank (3) engages the projection (57) on the locking body (54) to push the locking body rearwardly. This pushes the remainder of the locking assembly, ie. the washer (59), rings (27,52) and sleeve (50) rearwardly until the lock ring (52) is located rearwardly of the projection (55) on the tool release sleeve. Thereafter, the locking ring (52) and locking body (54) are free to shift in a direction transverse to the fore-aft axis of the tool holder body out of the path of the rearward end of the tool shank (3) into the position shown in FIG. 2. Then the tool shaft can move rearwardly in the tool holder body until the groove (88) in the shank (3) and comes to lie beneath the locking body (54). Thereafter, the forwardly directed spring force on the biasing ring (27) urges the locking ring (52) forwardly and transversely (downwardly in the Figures) back over the projection (55) due to the engagement of the chamfered forward face of the locking ring (52) and the rearwardly facing sloping face of the projection (55). This movement of the locking ring (52) causes the locking body to engage the groove (88) in the shank (3) of the tool, so that the locking assembly takes up the position shown in FIG. 1 with the tool securely locked within the tool holder. The other parts of the locking assembly move rearwardly with the locking ring (52).

In FIG. 1, the tool (3) is shown locked within the tool holder body (66) so as to be able to reciprocate to a limited extent within the tool holder body. The radially inward projection (57) on the locking body (54) engages within the groove (88) in the tool. The locking body (54) is in a radially inward locked position and is maintained in this position by the lock ring (52). The locking ring (52) is maintained in engagement with the locking body by the projection (55) on the tool holder body (66), which holds the locking ring in a downwardly shifted position, as shown in FIG. 1.

When it is desired to remove a tool (3) from the tool holder body (66), the tool release sleeve (50) is manually shifted axially rearwardly from its locked position shown in FIG. 1 to its release position shown in FIG. 2. This moves the locking ring (52) to the rear of the projection (55) which enables the locking ring to shift upwardly with respect to its position in FIG. 1 to enable the locking body (54) to move radially outwardly as the tool (3) is removed from the tool holder body (66). On removal of the tool, the rearward end of the groove (88) engages the projection (57) on the locking body (54) to urge the locking body radially outwardly, ie. upwardly in the Figures and the locking body (54) urges the locking ring (52) to shift upwardly into the position shown in FIG. 2. On release of the tool holder sleeve (50) after removal of the tool (3) from the tool holder body (66), the biasing sleeve (27) urges the locking ring (52) forwardly and the chamfer (53) on the forward face of the locking ring (52) engages the rearward slope of the projection (55) to urge the locking ring downwardly. Then the locking ring (52), locking body (54), washer (59) and biasing ring (27) can move forwardly, with the locking ring (52) moving over the projection (55) and forcing the locking body (54) radially inwardly, back into the position shown in FIG. 1, but with the tool removed.

As the tool shank (3) has a hexagonal transverse cross-section which is inserted into a bore in the tool holder body, which bore also has a transverse hexagonal cross-section, it is possible to insert the tool within the tool holder body in six different orientations. This problem is avoided for SDS-type tool shanks as they are designed with open ended groves which enable the tool shank to be inserted in a correct orientation only in order to engage corresponding splines in the tool holder body. Accordingly, for a hex-shanked tool, it is possible to insert the tool (3) into the tool holder body (66) in the wrong orientation, so that the groove (88) in the shank is not facing towards the locking body (54). In this case, on insertion of a tool (3) within the tool holder body the rearward end of the tool shank (3) engages the projection (57) on the locking body (54) to push the locking body rearwardly. This pushes the remainder of the locking assembly, ie. the washer (59), rings (27,52) and sleeve (50) rearwardly until the lock ring (52) is located rearwardly of the projection (55) on the tool release sleeve. Thereafter, the locking ring (52) and locking body (54) are free to shift in a direction transverse to the fore-aft axis of the tool holder body out of the path of the rearward end of the tool shank (3) and into the position shown in FIG. 2. Then the tool shaft can move to its rearward position within the tool holder body (66). However, if the groove (88) is not facing the locking body, the flat surface of the tool shank (3) facing the locking body (54) traps the locking body in its radially outward position shown in FIG. 2. With the locking body trapped in this way, the locking assembly is trapped in its rearward position on the tool holder body so that it cannot move forwardly under the force from the biasing sleeve, when a user releases the tool release sleeve (50). In particular, when the tool (3) is inserted in an incorrect orientation, the tool holder sleeve (50) is maintained in its rearward position on the tool holder body. This will be observed by the user of the tool who will then know that the tool shank (3) is not correctly locked within the tool holder body (66). The user will then remove the tool and re-insert it into the tool holder body in the correct orientation. When the tool shank is correctly reinserted, when the tool release sleeve (50) is released by the user, it will assume its forwards position on the tool holder body as shown in FIG. 1 and the user will know that the tool shank (3) is properly locked within the tool holder body. Thus, the tool holder as described above also has the advantage of providing a user of a hammer with a warning that a tool shank (3) is incorrectly inserted within the tool holder body (66).

What is claimed is:

1. A tool holder (2) for an electrically powered hammer comprising:

a tube-like tool holder body (66) which can be fitted to or formed at the front of the hammer and having a forward end for non-rotatably receiving a shank (3) of a tool or bit wherein said forward end is formed with a single axially extending slot (10);

a single locking body (54) extending through said slot for releasably engaging an axially extending closed groove (88) formed in a tool fitted in said forward end of the tool holder body (66); and a locking member (52) which extends around the tool holder body and in a locked position locks the locking body in a radially inward position in which the locking body is engageable with the groove in the tool and in a release position allows the locking body to move into a radially outward position to allow a tool to be inserted into or removed from the forward end of the tool holder body;

wherein the locking member (52) is shiftable in a direction transverse to the fore-aft axis of the tool holder body to allow the locking body to move into a radially outward position.

2. A tool holder according to claim 1 wherein the locking member (52) extends all the way around the tool holder body.

3. A tool holder according to claim 1 wherein the locking member is a locking ring (52).

4. A tool holder according to claim 1 wherein a manually actuable tool release member (50) can be actuated to move the tool release member (50) between a locked position which corresponds to the locked position of the locking member (52) and a release position which corresponds to the release position of the locking member (52).

5. A tool holder according to claim 1 wherein a manually actuable tool release member (50) can be actuated to move the locking member (52) between the locked position and an intermediate position, in which intermediate position the locking member is shiftable in a direction transverse to the fore-aft axis of the tool holder body to its release position to allow the locking body to move into a radially outward position.

6. A tool holder according to claim 1 wherein in the locked position the locking member (52) engages a protrusion (55) on the tool holder body in order to lock the locking member in its locked position.

7. A tool holder according to claim 1 wherein a manually actuable tool release member (50) is axially shiftable on the tool holder body to move the tool release member (50) between a locked position which corresponds to the locked position of the locking member (52) and a release position which corresponds to the release position of the locking member (52).

8. A tool holder according to claim 1 wherein a manually actuable tool release member (50) is moveable to axially shift the locking member (52) between the locked position of the locking member in which the locking member engages a protrusion (55) on the tool tool holder body in order to lock the locking member in its locked position and an intermediate position of the locking member in which in which the locking member does not engage the protrusion (55) and is shiftable in a direction transverse to the fore-aft axis of the tool holder body to its release position to allow the locking body to move into a radially outward position.

9. A tool holder according to claim 1 wherein a tool release sleeve (50) is mounted on the tool holder body and the locking member (52) is mounted within the tool release sleeve and the tool release sleeve is manually actuable to move the locking member (52) between the locked position and an intermediate position, in which intermediate position the locking member is shiftable in a direction transverse to the fore-aft axis of the tool holder body to its release position to allow the locking body to move into a radially outward position.

10. A tool holder according to claim 1 wherein a tool release sleeve (50) is mounted on the tool holder body and the locking member (52) is shiftably mounted within the tool release sleeve (50) between a first set of radially inwardly directed teeth (60, 62) of the sleeve (50) and a second set of radially inwardly directed teeth (64) of the sleeve (50) and the tool release sleeve is manually actuable to move the locking member (52) between the locked position and an intermediate position, in which intermediate position the locking member is shiftable between the teeth (60, 62, 64) in a direction transverse to the fore-aft axis of the tool holder body to its release position to allow the locking body to move into a radially outward position.

11. A tool holder according to claim 1 wherein the locking member (52) is biased by at least one spring member (24, 26) into the locked position.

12. A tool holder according to claim 1 wherein a biasing ring (27) surrounds the tool holder body and biases the locking member (52) into the locked position.

13. A tool holder according to claim 1 wherein the slot (10) in the tool holder body extends rearwardly of the locking body (10) and a biasing ring (27) surrounds the tool holder body and biases the locking member (52) and the locking body forwardly into their locked positions and the locking body (54) and the locking member (52) are axially moveable together such that insertion of a tool within the tool holder body pushes the locking body (54) axially rearwardly within the slot (10) and thereby pushes the locking member (52) and biasing ring (27) axially rearwardly against the biasing force of the biasing ring and into an intermediate position, in which intermediate position the locking member (52) is shiftable in a direction transverse to the fore-aft axis of the tool holder body to allow the locking body (54) to move into a radially outward position.

14. A tool holder according to claim 1 wherein a manually actuable tool release member (50) can be actuated to move the tool release member (50) between a locked position which corresponds to the locked position of the locking member (52) and a release position which corresponds to the release position of the locking member (52) and a biasing ring (27) surrounds the tool holder body and biases the locking member (52) into the locked position and the biasing ring engages a tool release member (50) so that axial movement of the biasing ring (27) causes axial movement of the tool release member (50).

15. A tool holder according to claim 1 wherein a manually actuable tool release member (50) can be actuated to move the tool release member (50) between a locked position which corresponds to the locked position of the locking member (52) and a release position which corresponds to the release position of the locking member (52) and a biasing ring (27) surrounds the tool holder body and biases the locking member (52) into the locked position and engages the tool release member (50) so that axial movement of the biasing ring (27) causes axial movement of the tool release member (50) and the locking member (52) is shiftably mounted within the tool release sleeve (50) between a first set of radially inwardly directed teeth (60, 62) of the member (50) and a second set of radially inwardly directed teeth (64) of the sleeve (50) and the biasing ring (27) engages a set of the teeth (64) of the sleeve (50), which teeth limit the movement of the biasing ring within the sleeve (50).

16. A tool holder according to claim 1 wherein the locking member (52) is shiftable in a locking assembly comprising a forward support member (59) located forwardly of the locking member and a rearward support member (27) located rearwardly of the locking member (52).

17. A tool holder according to claim 1 wherein a manually actuable tool release member (50) can be actuated to move the tool release member (50) between a locked position which corresponds to the locked position of the locking member (52) and a release position which corresponds to the release position of the locking member (52) in which release position the locking member (52) is shiftable in a locking assembly comprising a forward support member (59) located forwardly of the locking member and a rearward support member (27) located rearwardly of the locking member (52) and the locking assembly is axially fixed with respect to the tool release member (50).

18. A tool holder according to claim 1 wherein a manually actuable tool release member (50) is axially shiftable to move the tool release member (50) between a locked position which corresponds to the locked position of the locking member (52) and a release position which corresponds to the release position of the locking member (52) in which release position the locking member (52) is shiftable in a locking assembly comprising a forward support member (59) located forwardly of the locking member and a rearward support member (27) located rearwardly of the locking member (52) and the locking assembly is axially fixed within the tool release member (50).

19. A tool holder according to claim 1 wherein the locking member (52) is shiftable in a locking assembly comprising a forward support member (59) located forwardly of the locking member and a rearward support member (27) located rearwardly of the locking member (52) and a biasing ring (27) is formed by the rearward support member for biasing the locking member (52) into the locked position.

20. A tool holder according to claim 1 wherein the forward movement of the locking body (54) within the slot (10) is limited by a damping arrangement (72, 74, 78) which arrangement is axially fixed against forward movement on the forward portion of the tool holder body (66).

21. A tool holder according to claim 1 wherein the forward movement of the locking body (54) within the slot (10) is limited by a damping arrangement (72, 74, 78) comprising a metal ring (72), a resilient ring (74) located forwardly of the metal ring and a fixing ring (78) located forwardly of the resilient ring (74) and the arrangement is axially fixed against forward movement on the forward portion of the tool holder body (66).

22. A tool holder according to claim 1 wherein the tool is a hex-shanked tool having a shank (3) with a transverse hexagonal cross-section.

23. An electrically powered hammer having a tool holder, comprising:

a tube-like tool holder body (66) which can be fitted to or formed at the front of the hammer and having a forward end for non-rotatably receiving a shank (3) of a tool or bit wherein said forward end is formed with a single axially extending slot (10);

a single locking body (54) extending through said slot for releasably engaging an axially extending closed groove (88) formed in a tool fitted in said forward end of the tool holder body (66); and a locking member (52) which extends around the tool holder body and in a locked position locks the locking body in a radially inward position in which the locking body is engageable with the groove in the tool and in a release position allows the locking body to move into a radially outward position to allow a tool to be inserted into or removed from the forward end of the tool holder body;

wherein the locking member (52) is shiftable in a direction transverse to the fore-aft axis of the tool holder body to allow the locking body to move into a radially outward position.

24. A hammer according to claim 23 having a pneumatic striking mechanism comprising a piston and ram located so as to reciprocate within a hollow spindle.

25. A hammer according to claim 23 wherein the locking member (52) extends all the way around the tool holder body.

26. A hammer according to claim 23 wherein the locking member is a locking ring (52).

27. A hammer according to claim 23 wherein a manually actuable tool release member (50) can be actuated to move the tool release member (50) between a locked position which corresponds to the locked position of the locking member (52) and a release position which corresponds to the release position of the locking member (52).

28. A hammer according to claim 23 wherein a manually actuable tool release member (50) can be actuated to move the locking member (52) between the locked position and an intermediate position, in which intermediate position the locking member is shiftable in a direction transverse to the fore-aft axis of the tool holder body to its release position to allow the locking body to move into a radially outward position.

29. A hammer according to claim 23 wherein in the locked position the locking member (52) engages a protrusion (55) on the tool holder body in order to lock the locking member in its locked position.

30. A hammer according to claim 23 wherein a manually actuable tool release member (50) is axially shiftable on the tool holder body to move the tool release member (50) between a locked position which corresponds to the locked position of the locking member (52) and a release position which corresponds to the release position of the locking member (52).

31. A hammer according to claim 23 wherein a manually actuable tool release member (50) is moveable to axially shift the locking member (52) between the locked position of the locking member in which the locking member engages a protrusion (55) on the tool tool holder body in order to lock the locking member in its locked position and an intermediate position of the locking member in which in which the locking member does not engage the protrusion (55) and is shiftable in a direction transverse to the fore-aft axis of the tool holder body to its release position to allow the locking body to move into a radially outward position.

32. A hammer according to claim 23 wherein a tool release sleeve (50) is mounted on the tool holder body and the locking member (52) is mounted within the tool release sleeve and the tool release sleeve is manually actuable to move the locking member (52) between the locked position and an intermediate position, in which intermediate position the locking member is shiftable in a direction transverse to the fore-aft axis of the tool holder body to its release position to allow the locking body to move into a radially outward position.

33. A hammer according to claim 23 wherein a tool release sleeve (50) is mounted on the tool holder body and the locking member (52) is shiftably mounted within the tool release sleeve (50) between a first set of radially inwardly directed teeth (60, 62) of the sleeve (50) and a second set of radially inwardly directed teeth (64) of the sleeve (50) and the tool release sleeve is manually actuable to move the locking member (52) between the locked position and an intermediate position, in which intermediate position the locking member is shiftable between the teeth (60, 62, 64) in a direction transverse to the fore-aft axis of the tool holder body to its release position to allow the locking body to move into a radially outward position.

34. A hammer according to claim 23 wherein the locking member (52) is biased by at least one spring member (24, 26) into the locked position.

35. A hammer according to claim 23 wherein a biasing ring (27) surrounds the tool holder body and biases the locking member (52) into the locked position.

36. A hammer according to claim 23 wherein the slot (10) in the tool holder body extends rearwardly of the locking body (10) and a biasing ring (27) surrounds the tool holder body and biases the locking member (52) and the locking body forwardly into their locked positions and the locking body (54) and the locking member (52) are axially moveable together such that insertion of a tool within the tool holder body pushes the locking body (54) axially rearwardly within the slot (10) and thereby pushes the locking member (52) and biasing ring (27) axially rearwardly against the biasing force of the biasing ring and into an intermediate position, in which intermediate position the locking member (52) is shiftable in a direction transverse to the fore-aft axis of the tool holder body to allow the locking body (54) to move into a radially outward position.

37. A hammer according to claim 23 wherein a manually actuable tool release member (50) can be actuated to move the tool release member (50) between a locked position which corresponds to the locked position of the locking member (52) and a release position which corresponds to the release position of the locking member (52) and a biasing ring (27) surrounds the tool holder body and biases the locking member (52) into the locked position and the biasing ring engages a tool release member (50) so that axial movement of the biasing ring (27) causes axial movement of the tool release member (50).

38. A hammer according to claim 23 wherein a manually actuable tool release member (50) can be actuated to move the tool release member (50) between a locked position which corresponds to the locked position of the locking member (52) and a release position which corresponds to the release position of the locking member (52) and a biasing ring (27) surrounds the tool holder body and biases the locking member (52) into the locked position and engages the tool release member (50) so that axial movement of the biasing ring (27) causes axial movement of the tool release member (50) and the locking member (52) is shiftably mounted within the tool release sleeve (50) between a first set of radially inwardly directed teeth (60, 62) of the member (50) and a second set of radially inwardly directed teeth (64) of the sleeve (50) and the biasing ring (27) engages a set of the teeth (64) of the sleeve (50), which teeth limit the movement of the biasing ring within the sleeve (50).

39. A hammer according to claim 23 wherein the locking member (52) is shiftable in a locking assembly comprising a forward support member (59) located forwardly of the locking member and a rearward support member (27) located rearwardly of the locking member (52).

40. A hammer according to claim 23 wherein a manually actuable tool release member (50) can be actuated to move the tool release member (50) between a locked position which corresponds to the locked position of the locking member (52) and a release position which corresponds to the release position of the locking member (52) in which release position the locking member (52) is shiftable in a locking assembly comprising a forward support member (59) located forwardly of the locking member and a rearward support member (27) located rearwardly of the locking member (52) and the locking assembly is axially fixed with respect to the tool release member (50).

41. A hammer according to claim 23 wherein a manually actuable tool release member (50) is axially shiftable to move the tool release member (50) between a locked position which corresponds to the locked position of the locking member (52) and a release position which corresponds to the release position of the locking member (52) in which release position the locking member (52) is shiftable in a locking assembly comprising a forward support member (59) located forwardly of the locking member and a rearward support member (27) located rearwardly of the locking member (52) and the locking assembly is axially fixed within the tool release member (50).

42. A hammer according to claim 23 wherein the locking member (52) is shiftable in a locking assembly comprising a forward support member (59) located forwardly of the locking member and a rearward support member (27) located rearwardly of the locking member (52) and a biasing ring (27) is formed by the rearward support member for biasing the locking member (52) into the locked position.

43. A hammer according to claim 23 wherein the forward movement of the locking body (54) within the slot (10) is limited by a damping arrangement (72, 74, 78) which arrangement is axially fixed against forward movement on the forward portion of the tool holder body (66).

44. A hammer according to claim 23 wherein the forward movement of the locking body (54) within the slot (10) is limited by a damping arrangement (72, 74, 78) comprising a metal ring (72), a resilient ring (74) located forwardly of the metal ring and a fixing ring (78) located forwardly of the resilient ring (74) and the arrangement is axially fixed against forward movement on the forward portion of the tool holder body (66).

45. A hammer according to claim 23 wherein the tool is a hex-shanked tool having a shank (3) with a transverse hexagonal cross-section.

* * * * *